US006318212B1

(12) United States Patent
Gomas

(10) Patent No.: US 6,318,212 B1
(45) Date of Patent: Nov. 20, 2001

(54) METHOD FOR MAKING BLANKS FOR PARTS OF PLIERS

(75) Inventor: Herve Gomas, St. Fargeau (FR)

(73) Assignee: Bost Garnache Industries, Arbois (FR)

( * ) Notice: Subject to any disclaimer, the term of this patent is extended or adjusted under 35 U.S.C. 154(b) by 0 days.

(21) Appl. No.: 09/269,884

(22) PCT Filed: Oct. 1, 1997

(86) PCT No.: PCT/FR97/01737

§ 371 Date: Oct. 18, 1999

§ 102(e) Date: Oct. 18, 1999

(87) PCT Pub. No.: WO98/15370

PCT Pub. Date: Apr. 16, 1998

(30) Foreign Application Priority Data

Oct. 4, 1996 (FR) ..... 96 12141

(51) Int. Cl.[7] ..... B21K 5/00; B21C 23/14

(52) U.S. Cl. ..... 76/119; 76/101.1; 81/427.5

(58) Field of Search ..... 76/64, 69, 101.1, 76/119, 106.5; 81/177.1, 300, 415, 427.5, 489; 30/340, 341, 342

(56) References Cited

U.S. PATENT DOCUMENTS

| | | | | |
|---|---|---|---|---|
| 2,825,248 | * | 3/1958 | Ahlbin | 76/106.5 |
| 3,114,973 | * | 12/1963 | Kennedy | 30/342 |
| 4,024,634 | * | 5/1977 | Linden | 30/341 |
| 5,253,557 | * | 10/1993 | Dolak | 81/427.5 |
| 5,528,834 | * | 6/1996 | Seber et al. | 30/340 |
| 5,551,323 | * | 9/1996 | Beere et al. | 81/489 |
| 5,809,853 | * | 9/1998 | Hudson | 81/427.5 |

FOREIGN PATENT DOCUMENTS

| | | | | |
|---|---|---|---|---|
| 0570340 | | 11/1993 | (EP) . | |
| 0 538 632 | * | 4/1993 | (EP) | 81/427.5 |
| 1054724 | | 2/1954 | (FR) . | |
| 2622657 | | 5/1989 | (FR) . | |
| 213812 | * | 4/1924 | (GB) | 81/427.5 |

OTHER PUBLICATIONS

Patent Abstract of Japan vol. 009, No. 215 (m–409) Sep. 3, 1985 Riken Khaki Kogyo KK Apr. 30, 1985 JP 60 076235A.

* cited by examiner

*Primary Examiner*—Hwei-Slu Payer
(74) *Attorney, Agent, or Firm*—Dowell & Dowell, P.C.

(57) ABSTRACT

The method consists in cutting out the outlines (11) of a series of blanks in lengths of shaping sections (10) of variable thickness whereof the cross-section corresponds at least to one cross-section of the blanks. The invention is useful for making clamp jaws and elements of various pliers.

18 Claims, 8 Drawing Sheets

FIG. 10
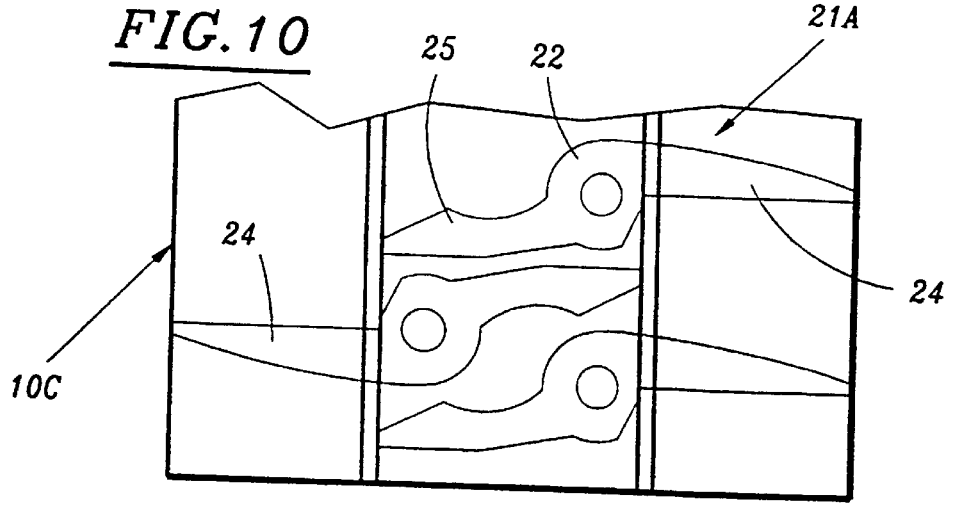
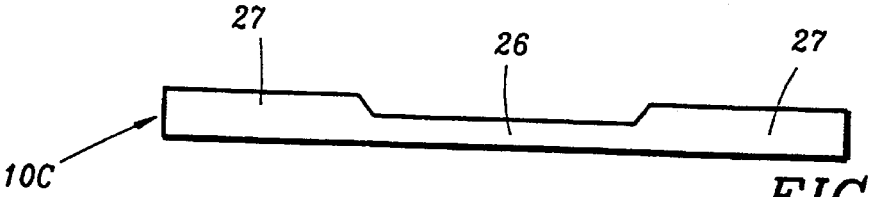
FIG. 11
FIG. 12
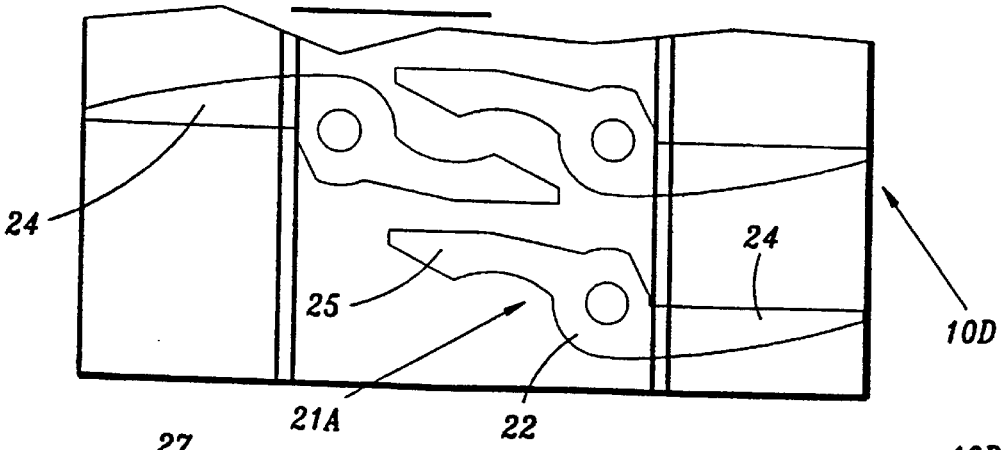
FIG. 13
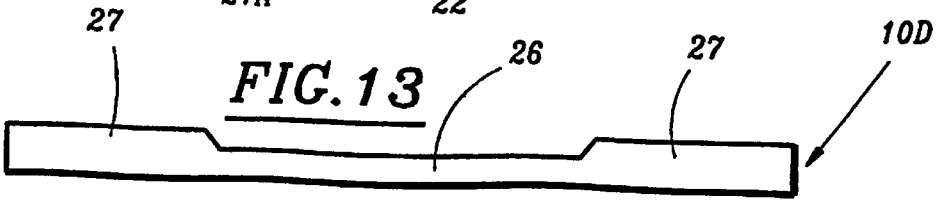

FIG. 14
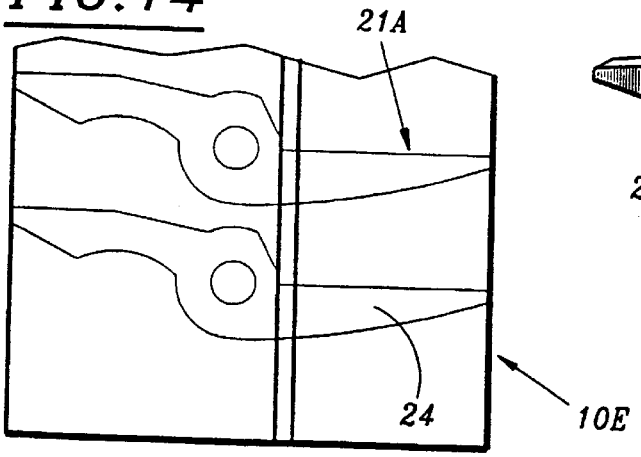
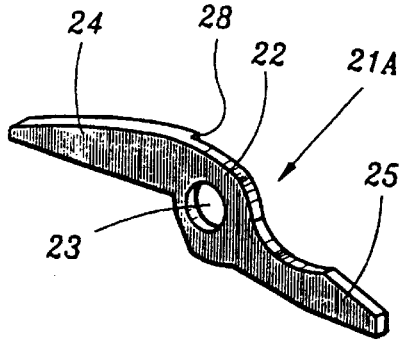
FIG. 18
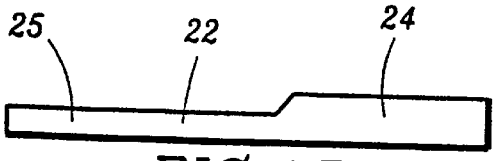
FIG. 15
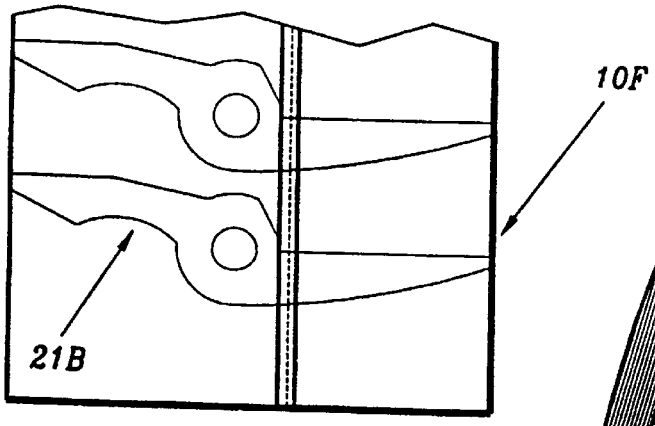
FIG. 16
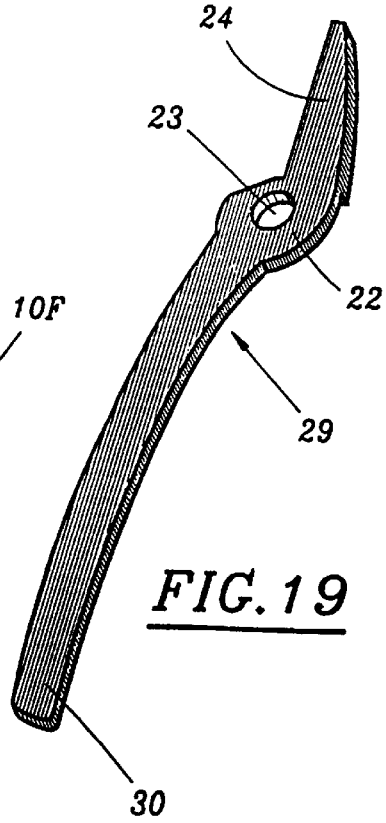
FIG. 19
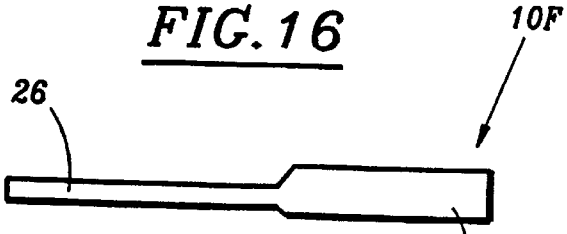
FIG. 17

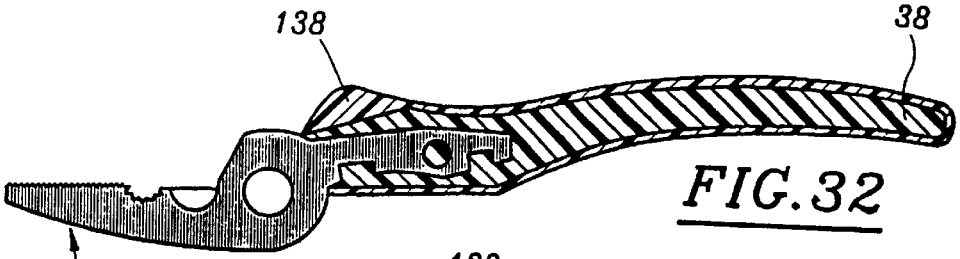
FIG. 32
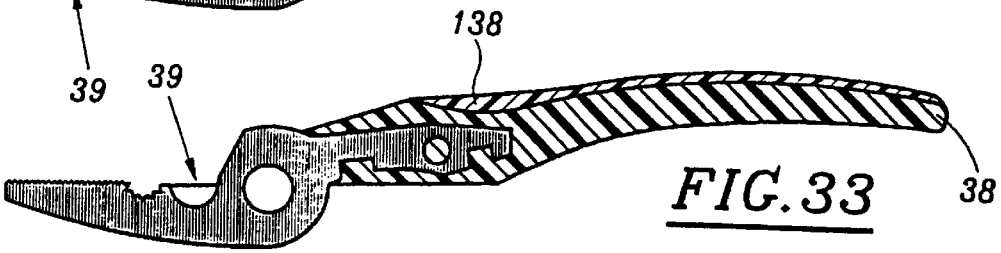
FIG. 33
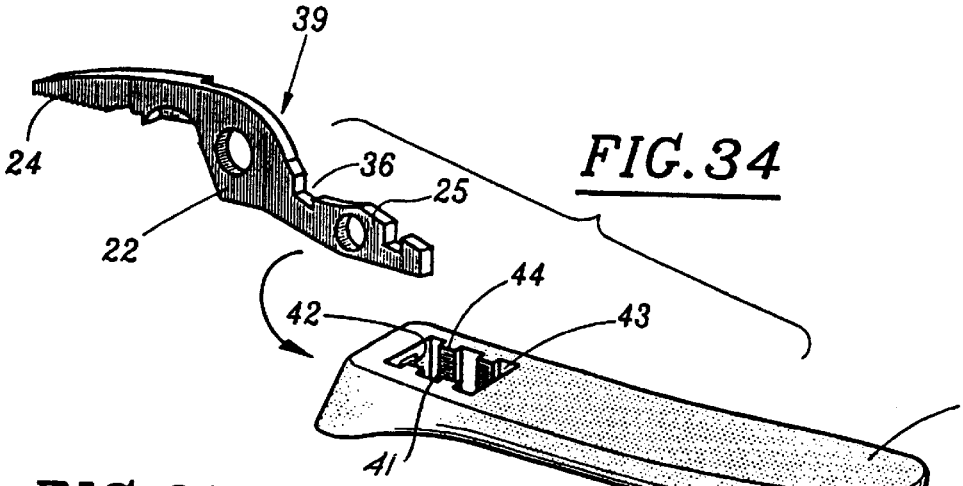
FIG. 34
FIG. 35
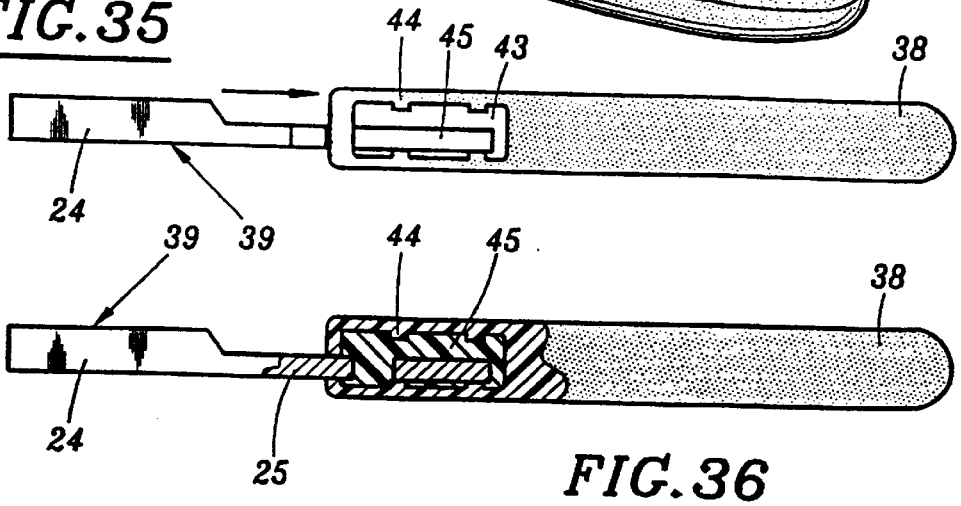
FIG. 36

METHOD FOR MAKING BLANKS FOR PARTS OF PLIERS

BACKGROUND OF THE INVENTION

1. Field of the Invention

The present invention relates to a method of anufacturing blanks for metallic components of pliers comprising a jaw.

2. Description of the Related Art

Current techniques for manufacturing metallic components of pliers, namely the gripping jaws of pairs of multi-grip pliers and the working heads and/or the arms of the other types of pliers, entail the managing of an expensive and complex array of tooling. This is because these known techniques involve forging or cutting/pressing flat sheet.

SUMMARY OF THE INVENTION

The object of the invention is to allow broad ranges of pliers to be produced on an industrial scale with a smaller amount of tooling, and therefore in a particularly economical way.

To this end, the manufacturing method according to the invention is characterized in that the outline of each blank is cut out from a length of profile of shape of variable thickness, the cross section of which corresponds to at least one cross section of the blank.

Another subject of the invention is a method of manufacturing half a pair of pliers. According to a first alternative form, a blank which has a pliers arm core is produced in the way described above, and a pliers handgrip is overmoulded onto this core. Advantageously, in this case, the overmoulding mould is closed onto an adapter ring slipped over the arm core.

According to a second alternative form, a blank which has a pliers arm core is produced in the way described above, the branch core is introduced with clearance into a cavity of a preformed handgrip, and the remaining empty space in this cavity is filled with a filling substance. The said cavity may especially open to the front and to the side.

A further subject of the invention is a shaped section piece intended for implementing a method as defined above.

BRIEF DESCRIPTION OF THE DRAWINGS

Some embodiments of the invention will now be described with reference to the appended drawings, in which:

FIGS. 8, 10, 12, 14 and 16 are views similar to FIG. 6 but relating to other shaped section pieces;

FIGS. 9, 11, 13, 15 and 17 depict the respective cross sections of these shaped section pieces;

FIG. 18 depicts, in perspective, pliers member blank obtained from any one of the section pieces of FIGS. 8 to 15;

FIG. 19 depicts, in perspective, a half-pair of pliers blank produced in accordance with the invention;

FIGS. 32 and 33 show diagrammatically, in longitudinal section, two alternative forms of the half pair of pliers of FIG. 29;

FIG. 34 illustrates, in perspective, another embodiment of a half pair of pliers starting from the pliers member of FIG. 28;

FIG. 35 is a corresponding plan view; and

FIG. 36 is a plan view, partially in section, showing the finished half pair of pliers.

FIG. 1 depicts the blank 1 of a single-piece gripping jaw intended to equip the adjustable arm of a pair of multi-grip pliers. This blank consists of a thick jaw 2 of constant thickness E, typically of the order of 9 mm, and of an attachment heel 3 of far smaller constant thickness e, typically of the order of E/2, namely of the order of 4 mm. There is an intermediate bead 4 between the jaw and the heel. The blank is symmetric with respect to its mid-plane P.

Figure 1:
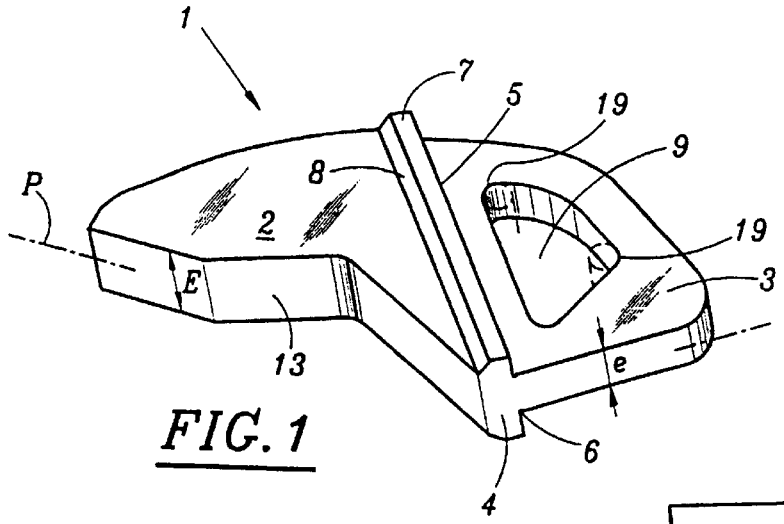
FIG. 1 depicts, in perspective, a blank of the gripping jaw of a pair of multi-grip pliers produced in accordance with the invention.

The heel 3 is delimited, on each face, by a straight shoulder 5 essentially perpendicular to the plane P. At its root, at the heel end, the shoulder 5 is bordered by a straight clearance groove 6. At the other end, the shoulder 5 connects to a short flat surface 7 parallel to the plane P then rejoins the root of the jaw 2 via an inclined face 8. The angle $\alpha$ of this inclined face to the perpendicular to the plane P is preferably at least equal to 30° and for example close to this value. Furthermore, the heel 3 has passing through it a broad cutout 9 of oblong shape with rounded ends.

Figure 2:
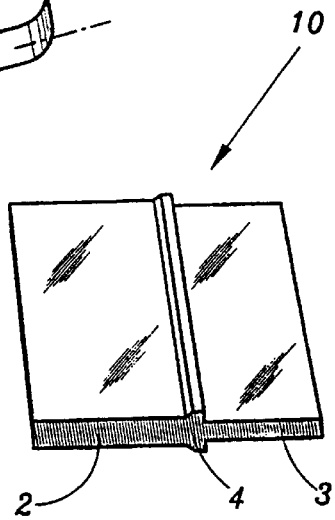
FIG. 2 depicts, in perspective, a shaped section piece from which the gripping jaw blank of FIG. 1 is produced.
Figure 3:
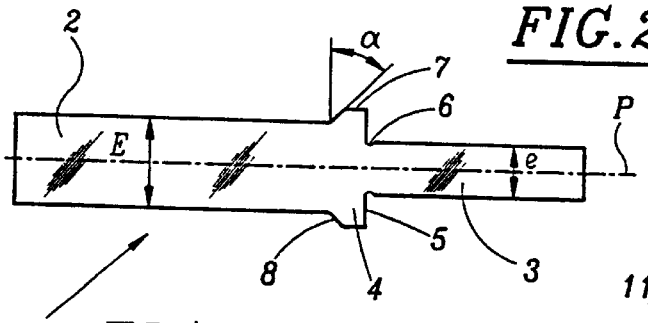
FIG. 3 depicts the cross section of this section piece.

A series of blanks 1 is made from a profile of shape or shaped section piece 10 formed of one single piece of material obtained by extrusion, depicted in FIGS. 2 and 3.

This section piece has the same cross section as the blank 1 when looking at the shoulders 5 end on. Thus, re-using the same numerical references as were used above, it consists of a part 2 of rectangular cross section, of constant thickness E, of a part 3 of rectangular cross section of constant thickness e and, between these two parts, of a thickened part 4. The latter has, at the same side as the part 2, two faces 8 which are inclined at the aforementioned angle α; on the other side, it has two faces 5 which are perpendicular to the mid-plane P, each face bordered by a clearance groove 6. The faces 8 and S are connected on each side by a face 7 parallel to the plane P.

Figure 4:
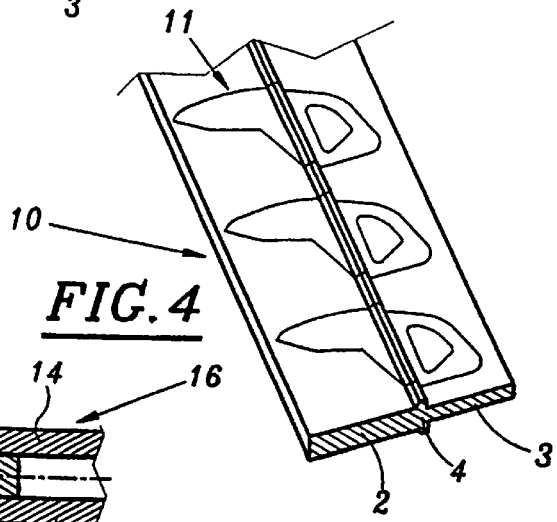
FIG. 4 illustrates, in perspective, the cutting of blanks, such as the one in FIG. 1, from this section piece.

Thus, as depicted in FIG. 4, it is possible, in a single operation of cutting the section piece 10, performed at right angles to the plane P, to obtain a series of blanks 1 with the repetitive outlines 11 shown. To achieve this, use is of course made of a three-dimensional die and of a three-dimensional punch each matching the shape of one face of the section piece. Note that the presence of the grooves 6 makes it possible to press down flat on the faces of the part 3, right up to the shoulders 5, while the inclination α of the faces 8 makes it easier to centre the profile and obtain good cutting quality.

Figure 5:
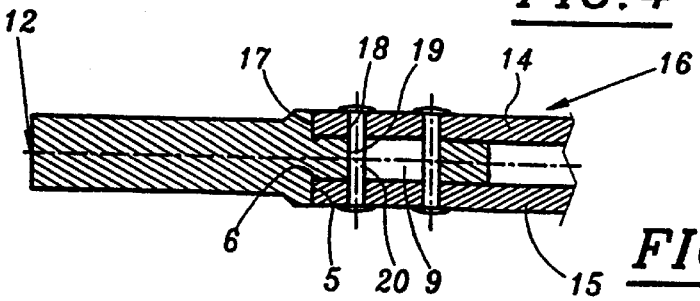
FIG. 5 depicts diagrammatically, in longitudinal section, an arm of a pair of multi-grip pliers equipped with a gripping jaw obtained from the blank of FIG. 1.

Depicted in FIG. 5 is the entire gripping jaw 12 consisting of the blank 1 machined in the active region 13 (FIG. 1) of the jaw 2, with two sheet metal parts 14, 15 of elongate shape, flat in their front region, gripping the heel 3, to produce the adjustable arm 16 of a pair of multi-grip pliers.

Each part 14, 15 ends, at the front, in a straight edge 17 which rests against the corresponding shoulder 5 along its entire length. This resting, which is made reliable by the presence of the clearance grooves 6, allows the clamping forces to be taken up when the tool is in use. Each part 14, 15 additionally comprises two orifices 18 each of which is inscribed in a rounded end portion 19 of the cutout 9, as shown in chain line in FIG. 1. The parts 12, 14 and 15 are assembled using two rivets 20 which pass through these orifices 18 and through the cutout 19. As they are compressed, the shanks of the two rivets expand, and this presses them firmly against the edges of the rounded portions 19.

Figure 6:
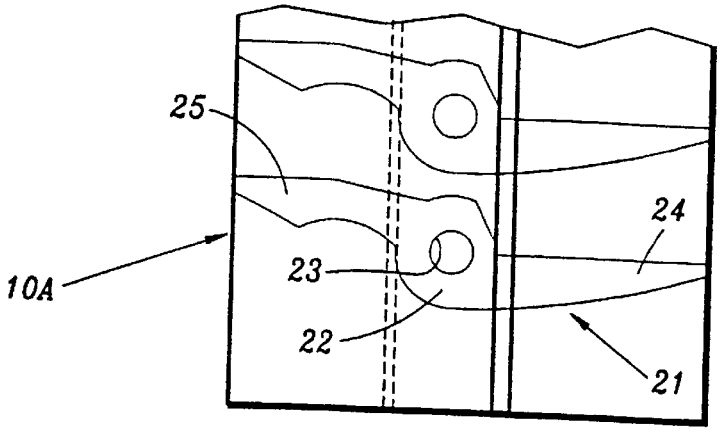
FIG. 6 illustrates the cutting of blanks of a pair of pliers member from a shaped section piece in accordance with the invention.
Figure 7:
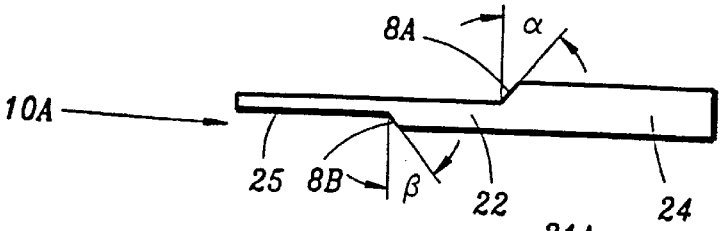
FIG. 7 depicts the cross section of the shaped section piece.

FIGS. 6 and 7 show the embodiment simply by cutting out a series of single-piece members 21 of pairs of pliers from a shaped section piece 10A.

Each member 21 forms half an inset joint or half an articulation region 22, equipped with an orifice 23 for the passage of the pliers articulation pin; on one side of this region, one jaw 24 of the pair of pliers; and on the other side of the region 22, an arm core 25. In the example depicted, the jaw 24 is of the universal pliers nose type.

The shaped section piece 10A has, in cross section, three successive parts of increasing thickness: a thick part 24 on the jaw side, an intermediate part 22 corresponding to the half-inset joint, and a thin part 25 corresponding to the arm core. On one face (the upper face in FIG. 7) the section piece is flat across all of the parts 22 and 25, and one face 8A inclined at the aforementioned angle α connects this plane to the parallel flat plane of the part 24. On the other face, the section piece is flat over the entirety of the parts 22 and 24, and a face 8B inclined at an angle β preferably at least equal to 30°, for example equal to α, connects this plane to the parallel flat plane of the part 25.

As depicted in FIG. 6, a series of members 21 is obtained simply by cutting out from the section piece 10A, with their main direction essentially perpendicular to the length of the section piece.

Figure 8:
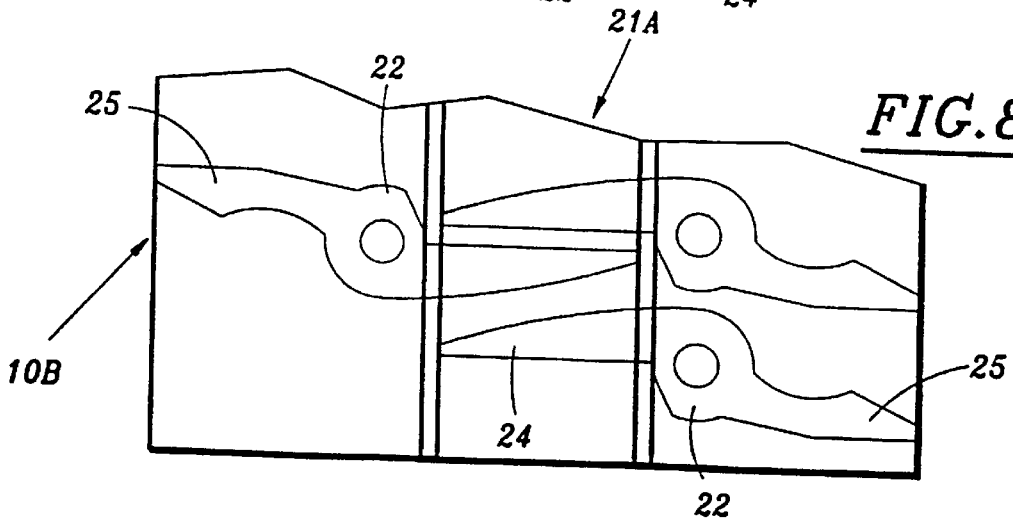
Figure 9:
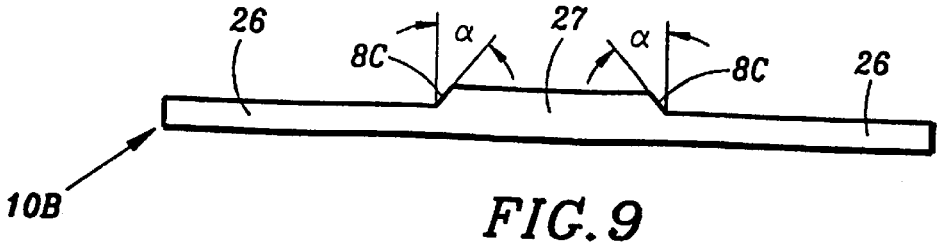

In the alternative form of FIGS. 8 and 9, the section piece 10B comprises two thin lateral parts 26 of the same thickness, and a thicker central part 27. It is flat over the entirety of one of its faces, and on the other face, the part 27 is bordered by two faces 8C which are inclined by the angle α. The flat lower face makes it possible to use a flat cutting die.

Simply by cutting, a series of pliers members 21A similar to the one in FIGS. 6 and 7 but in which the parts 22 and 25 have the same thickness can be produced from the section piece 10B. The members 21A are cut out top-to-tail, with the noses 24 nested between each other in the central region 27 of the section piece.

The same members 21A may be cut out from the shaped section piece 10C depicted in FIGS. 10 and 11, which comprises a thin central part 26 and two thick lateral parts 27. Again, the section piece has one entirely flat face. In this case, the noses 24 are cut from the parts 27, and it is the regions 22, 25 which are arranged top-to-tail in the central part 26.

FIGS. 12 and 13 illustrate an alternative form very similar to the previous one. However, the central region 26 of the section piece 10D is broader, which allows the blanks 21A to be cut out to be moved closer together.

The alternative form of FIGS. 14 and 15 is similar to those of FIGS. 6 and 7, with the exception that the regions 22 and 25 of the section piece 10E have the same thickness, which makes it possible to give the section piece 10E one face which is entirely flat. The members obtained are of the 21A type.

The alternative form 10F of FIGS. 16 and 17 differs from that of FIGS. 6 and 7 only by the fact that the inclined lower face 8B is vertically aligned with the inclined upper face 8A. The members 21B obtained by cutting out from this section piece 10F therefore differ correspondingly from the members 21.

FIG. 18 depicts, in perspective, a pliers member blank 21A obtained by cutting out from the section piece 10B, 10C, 10D or 10E. This blank comprises a flat face and, on the other side, a gradual change in thickness 28 at the root of its nose 24.

By increasing the length of the or of each part of the section piece that corresponds to the branch core 25 (part 25 in FIGS. 6 and 7, part(s) 26 in FIGS. 8 to 17), it is possible in the same way simply by cutting to produce a half-pair of pliers blank 29 like the one depicted in FIG. 19. This blank differs from the blank 21A of FIG. 18 only by the fact that the core 25 has been extended to form a complete half-arm core structure 30.

Not only does the cutting-out method described above make it possible to produce a given blank on an industrial scale at a high rate in an accurate and economical way, but it also makes it possible, starting from the same section piece, to produce an entire range of blanks which, for example, differ from one another only in the shape of the working head.

Figure 20:
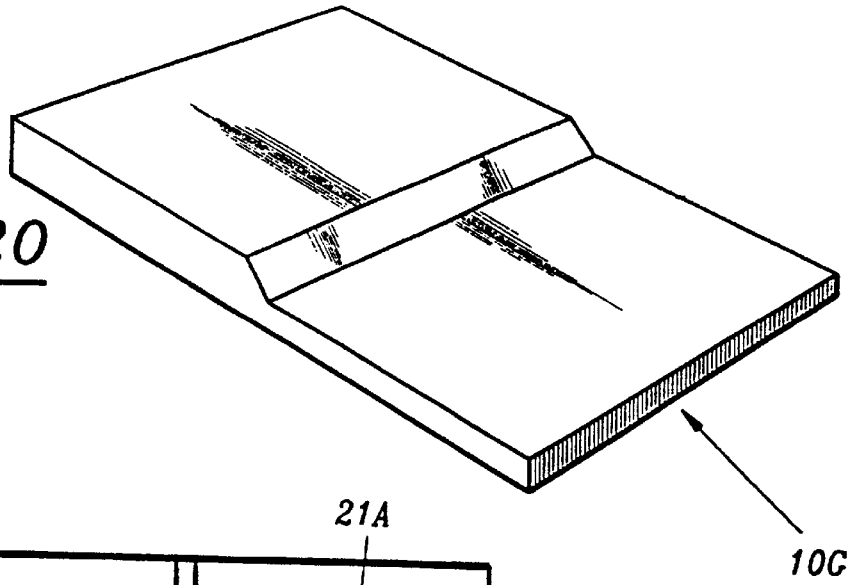
FIG. 20 depicts, in perspective, a section piece similar to the one in FIGS. 14 and 15.
Figure 21:
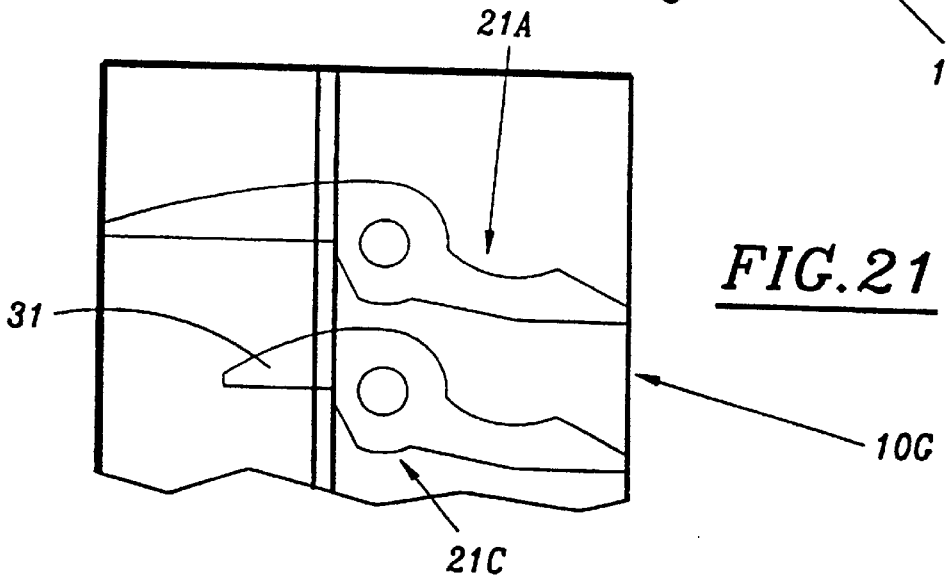
FIG. 21 illustrates the cutting of blanks of two different pliers members from this section piece.

Thus, FIG. 20 depicts a section piece 10G similar to the one in FIGS. 14 and 15, and FIG. 21 shows that from this section piece it is possible to cut out either one universal pliers member blank 21A like the one in FIG. 18, or a rounded-nosed pair of cutting pliers member blank 21C. Of course, many other configurations of blanks produced from one and the same shaped section piece are conceivable. The overall tooling to allow a range of pairs of pliers to be manufactured is therefore particularly economical.

The need to manage an array of shaped section pieces may even be completely dispensed with if the starting point can be a basic section piece with a simple cross section in which it is possible to produce, by cold or hot forging, a series of lengths of shaped section piece in each of which a cutout can be inscribed, which cutout is achieved in a later stage.

Figure 22:
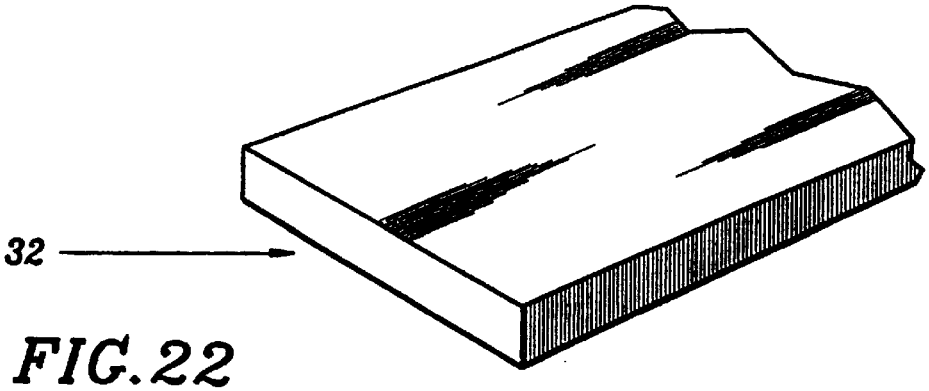
FIG. 22 depicts, in perspective, a basic section piece of rectangular cross section.
Figure 23:
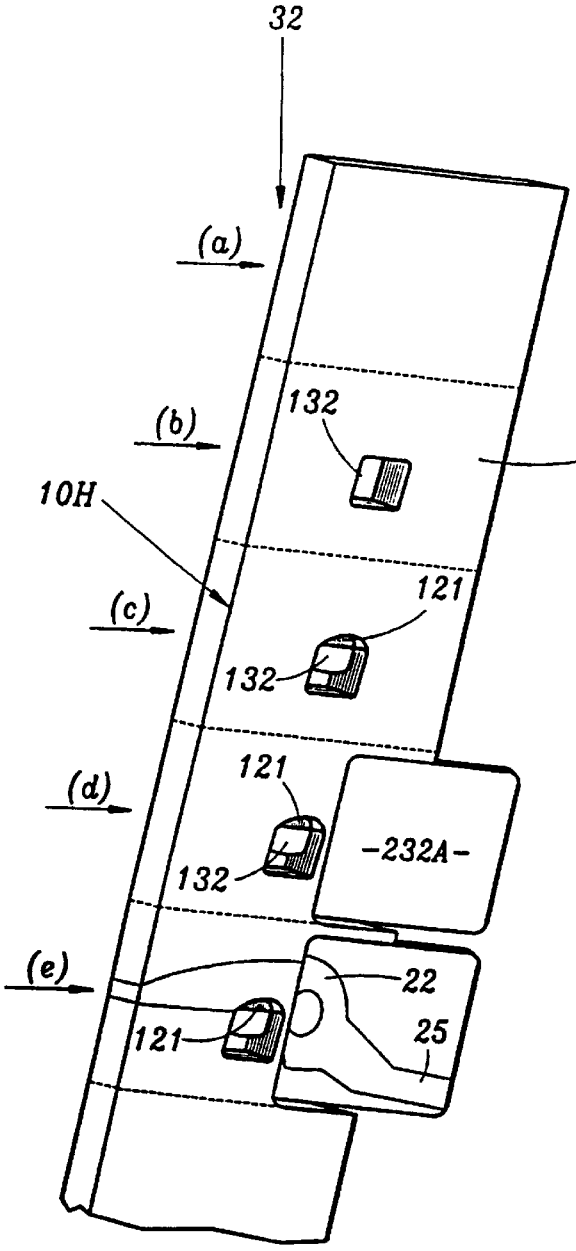
FIG. 23 depicts the forging of localized lengths of shaped section piece in this basic section piece, and the cutting of half pair of pliers blanks from these localized lengths.

Thus, in the example of FIGS. 22 and 23, the starting point is a basic section piece or strip 32 of rectangular cross section, the thickness of which is the maximum thickness to be envisaged in the cutout (namely the thickness E of the nose 24 in the examples mentioned above).

Figure 24:
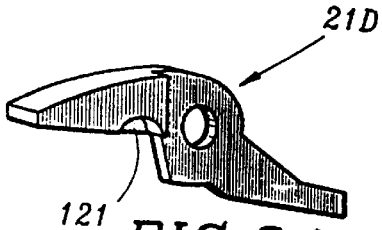
FIG. 24 depicts, in perspective, the blank thus obtained.

This basic section piece is forged in a number of stages (FIG. 23) to form a series of lengths of shaped section pieces 10H in each of which a cutout, which for example is that of the blank 21D for half a pair of universal pliers of FIG. 24, can be inscribed.

Thus, starting from the rectangular section piece illustrated as (a), the following stages are performed:

(b) a localized cutout 132 is made more or less at the centre of a length of section piece 232;

(c) this cutout is locally forged to form the cutting edge 121 of the blank;

(d) the part 232A of the length of section piece located on one side of the forged cutout 132 is forged to bring it to the desired thickness for the parts 22 and 25 of the blank; this then yields a length of shaped section piece 10I; and (e) the blank 21D with cutting edge 121 depicted in FIG. 24 is cut out.

Such a method makes it possible to dispense with the later phase of machining the cutting edge 121.

Figure 25:
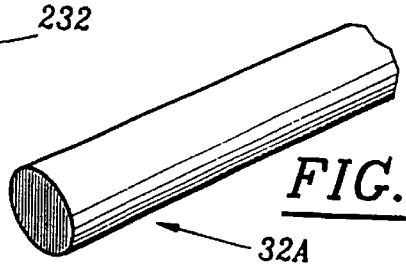
FIG. 25 depicts, in perspective, a basic section piece of circular cross section.
Figure 26:
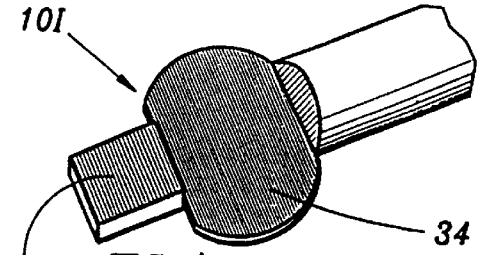
FIG. 26 illustrates the forging of localized lengths of shaped section piece in this basic section piece.
Figure 27:
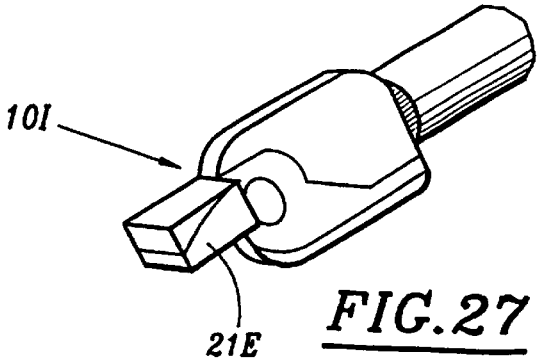
FIG. 27 illustrates the cutting of pliers member blanks from these localized lengths.

Likewise, in the example of FIGS. 25 to 27, the starting point is a basic section piece 32A of circular cross section (FIG. 25), for example paid out from a reel, and a succession of lengths of shaped section pieces 10I (FIG. 26) are produced by forging, each consisting of a length 33 of rectangular cross section followed by a length 34 with cut faces, of small thickness. Cutting out from each section piece 10I (FIG. 27) gives rise to one pliers member, in this example a member 21E of a pair of cutting pliers. It can be seen that in this example, the longitudinal dimension of the blank 21E is essentially parallel to the length of the section piece.

FIGS. 28 to 36 illustrate three different ways of finishing a half pair of pliers starting from a pliers member blank 21F which differs from the blank 21A of FIG. 18 only in the presence of reliefs 36, such as recesses and an orifice, on the branch core 25. The reliefs 36 may be obtained by the cutting-out operation itself.

Figure 28:
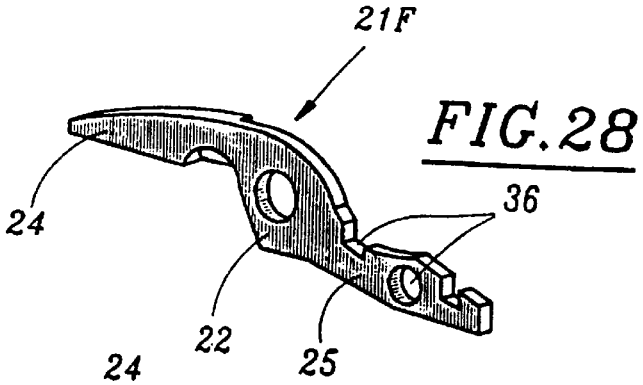
FIG. 28 depicts, in perspective, another pair of pliers member blank produced in accordance with the invention and machined to constitute a member of a pair of pliers.
Figure 29:
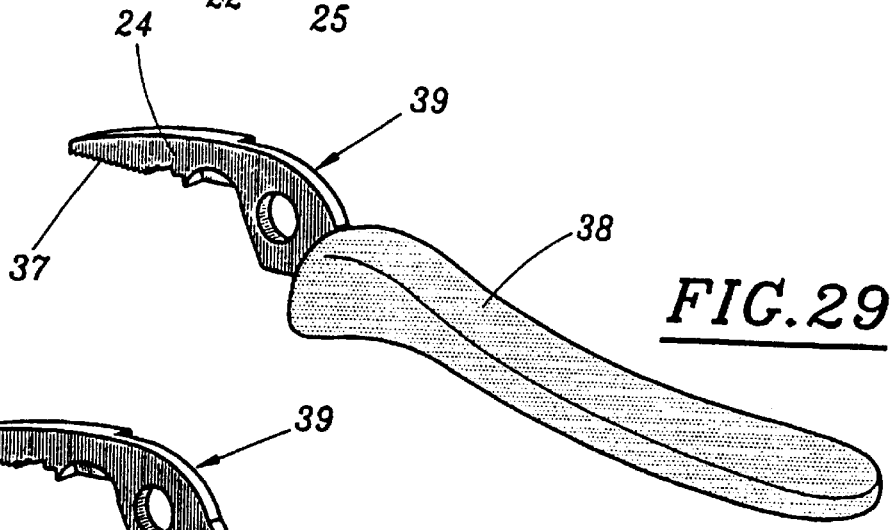
FIG. 29 depicts, in perspective, the corresponding member of the pair of pliers, over which member a pliers handgrip has been overmoulded.

Having machined the blank at 37 in the active region of the nose 24, in order to turn it into a pliers member 39, in the example of FIGS. 28 and 29, the handgrip 38 is simply overmoulded onto the core 25. This handgrip may be made of aluminium, aluminium alloy or of a thermoplastic or thermoset which may or may not be reinforced.

Figure 30:
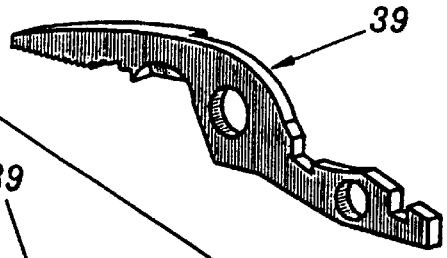
FIG. 30 depicts, in perspective, the same pliers member and an attached ring.
Figure 31:
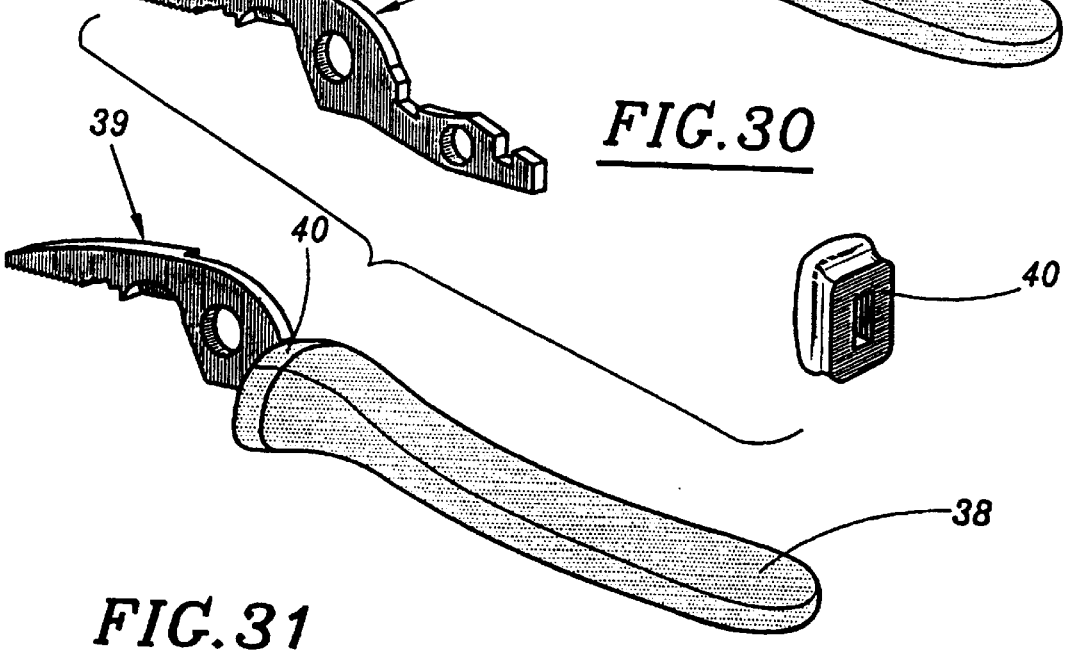
FIG. 31 depicts the same pliers member fitted with the attached ring and over which a pliers handgrip has been overmoulded.

In the alternative form of FIGS. 30 and 31, the starting point is to slip a ring 40 forcibly, or at least as a sealed joint, over the core 25 and then the mould used for overmoulding the handgrip is closed over this ring. The finished half pair of pliers is depicted in FIG. 31. The ring 40 is made of a substance which has a certain degree of flexibility or ductility so that it can internally adapt to the dimensional variations of the core 25 and externally adapt to the contour of the closed mould. This substance is, for example, a plastic or aluminium. The front part of the ring 40, enlarged on the outside, is visible at the front of the handgrip and extends the latter.

As depicted in FIGS. 32 and 33, as an alternative, it is possible to carry out a second overmoulding operation 138 on the handgrip 38 to form a complete (FIG. 32) or partial (FIG. 33) coating made of relatively flexible substance or "grip". It is thus possible to obtain an entire range of pairs of pliers starting from the same basic handgrip 38.

In the alternative form of FIGS. 34 to 36, the plastic handgrip 38 is made independently by moulding and has a cavity 41 which opens at its front end in an opening 42 and opens at its side through an opening 43 (FIG. 34). The walls of the cavity 41 have reliefs 44. The core 25 of the pliers member is introduced through the opening 42 (FIG. 35), then additional plastic 45 is overmoulded into the cavity 41 to secure the two parts together (FIG. 36). It is, of course, possible to modify the handgrip in the same way as in FIGS. 32 and 33.

In each of the alternative forms of FIGS. 28 to 36, the reliefs 36 of the pliers member, and possibly 44 of the handgrip, improve the adhesion between the two parts after overmoulding.

It is to be noted that the methods of finishing the arm which are described hereinabove with regard to FIGS. 28 to 36 are also applicable to metallic embers obtained by any other appropriate method, for example by forging or cutting/pressing flat sheet.

In addition, it is possible, in the case of a two-shot injection-moulded handgrip, to apply the technique described with relation to a screwdriver handle in FR-A-2, 730,658 in the name of the applicant company, namely, during the last overmoulding operation, to close the mould by pressing a gripping rib thereof against a step in the underlying injected part.

What is claimed is:

1. A method of manufacturing a half pair of pliers, wherein:

to produce a blank which comprises a jaw and a pliers arm core, an outline of the blank is cut out from a respective length of profile of shape of variable thickness, the cross section of which corresponds to at least one substantially longitudinal cross section of the blank;

the arm core is introduced with clearance into a cavity of a preformed handgrip; and remaining empty space in said cavity is filled with a filling substance.

2. A method as claimed in claim 1, wherein the cavity of the preformed handgrip is open toward the jaw in order to receive the arm core and to one side of the handgrip.

3. A method of manufacturing blanks for metal components of pliers wherein the blank includes a jaw and an extending heelpiece, wherein each blank is cut out from a respective length of profile of shape of variable thickness the cross section of which corresponds to at least one substantially longitudinal cross section of the blank, and wherein said step of cutting out includes cutting a first portion of said profile of variable thickness to form the jaw and cutting a second portion of said profile of variable thickness to form the heelpiece and wherein the second portion is of a lesser thickness than said first portion of said profile of variable thickness.

4. A method of manufacturing a half pair of pliers, wherein:

in order to produce a blank which comprises a jaw and a pliers arm core, an outline of the blank is cut out from a respective length of profile of shape of variable thickness, the cross section of which corresponds to at least one substantially longitudinal cross section of the blank; and overmolding a pliers handgrip onto said arm core.

5. A method as claimed in claim 4, wherein an overmolding mold is closed onto an adapter ring slipped over the arm core.

6. A strip of material from which blanks of metal components for pliers can be cut which includes a profile of shape of constant cross section and yet variable thickness which profile of shape is adapted to be cut out to form the blanks of metal components of the pliers and which blanks have at least two portions of different thickness and with one of said portions including a jaw component.

7. A method of manufacturing blanks for metal components of pliers comprising a jaw, wherein each blank is cut out from a respective length of profile of shape of constant transverse cross section and variable thickness, the transverse cross section of said length of profile of shape corresponding to at least one substantially longitudinal cross section of the blank, and said length of profile of shape being made from a single piece of material.

8. A method as claimed in claim 7, wherein the cross section of the length of profile of shape is symmetric in a transverse direction, and blanks arranged top-to-tail are produced by cutting-out from said length.

9. A method as claimed in claim 7, wherein at least two blanks of different shapes are cut out from the length of profile of shape.

10. A method of manufacturing blanks for metal components of pliers comprising a jaw, wherein an outline of each blank is cut out from a respective length of profile of shape of variable thickness, the cross section of which corresponds to at least one cross section of the blank wherein starting from a basic section piece which has a different cross section from the length of profile of shape, at least one forging operation is used to form said basic section piece into localized lengths of profile of shape, and the cutting-out is performed in each of said localized lengths.

11. A method as claimed in claim 10, wherein the basic section piece is provided as a strip or bar having a cross section selected from one which is rectangular, polygonal or in a shape of a closed curve.

12. A method as claimed in claim 11, wherein said closed curve is a circle.

13. A method as claimed in claim 11, wherein said section piece is paid out from a reel.

14. A method of manufacturing blanks for metal components of pliers comprising a jaw, wherein each blank is cut out from a respective length of profile of shape of variable thickness the cross section of which corresponds to at least one substantially longitudinal cross section of the blank, wherein the length of profile of shape has, on one side, over its entire extent, a flat face for resting on a flat cutting-out die.

15. A method of manufacturing blanks for metal components of pliers comprising a jaw, wherein each blank is cut out from a respective length of profile of shape of variable thickness the cross section of which corresponds to at least one substantially longitudinal cross section of the blank, wherein the length of profile of shape has at least one change-of-thickness surface which is inclined with respect to a direction perpendicular to the mid-plane of said length.

16. A method as claimed in claim 15, wherein said change-of-thickness surface is inclined at about 30° with respect to said perpendicular.

17. A method of manufacturing blanks for metal components of pliers comprising a jaw, wherein an outline of each blank is cut out from a respective length of profile of shape of variable thickness, the cross section of which corresponds to at least one cross section of the blank wherein the length of profile of shape includes at least one shoulder substantially perpendicular to a mid-plane thereof.

18. A method as claimed in claim 17, wherein said shoulder has a root having a clearance groove running alongside said shoulder.

* * * * *